US005361477A

United States Patent [19]

Semiatin et al.

[11] Patent Number: 5,361,477

[45] Date of Patent: Nov. 8, 1994

[54] CONTROLLED DWELL EXTRUSION OF DIFFICULT-TO-WORK ALLOYS

[75] Inventors: Sheldon L. Semiatin, Dayton; Venkat Seetharaman, Beavercreek; Robert L. Goetz, Centerville; Vinod K. Jain, Dayton, all of Ohio

[73] Assignee: The United States of America as represented by the Secretary of the Air Force, Washington, D.C.

[21] Appl. No.: 208,179

[22] Filed: Mar. 10, 1994

[51] Int. Cl.[5] ..... B23P 17/00

[52] U.S. Cl. ..... 29/423; 29/527.1; 29/DIG. 47; 72/253.1

[58] Field of Search ..... 29/423, 527.1, DIG. 47; 72/253.1, 272

[56] References Cited

U.S. PATENT DOCUMENTS 1,345,441 7/1920 Hisamoto ..... 29/423
2,711,966 6/1955 Watson et al. ..... 29/423

FOREIGN PATENT DOCUMENTS 4-138816 5/1992 Japan ..... 29/DIG. 47
902881 2/1982 U.S.S.R. ..... 72/253.1

*Primary Examiner*—Mark Rosenbaum
*Assistant Examiner*—David P. Bryant
*Attorney, Agent, or Firm*—Bobby D. Scearce; Thomas L. Kundert

[57] ABSTRACT

A method for extruding metals and alloys, particularly difficult-to-work high temperature alloys, is described which comprises inserting a billet of the metal or alloy into an extrusion can, heating the canned billet to a temperature in a temperature range in which the ductility of the billet material is substantially maximum, cooling the canned billet sufficiently to establish a preselected temperature difference between the billet and can at which the difference between the flow stress of the billet material and the flow stress of the can material is substantially minimum, and extruding the canned billet to preselected shape.

5 Claims, 2 Drawing Sheets

CONTROLLED DWELL EXTRUSION OF DIFFICULT-TO-WORK ALLOYS

RIGHTS OF THE GOVERNMENT

The invention described herein may be manufactured and used by or for the Government of the United States for all governmental purposes without the payment of any royalty.

BACKGROUND OF THE INVENTION

The present invention relates generally to methods for extruding metals and alloys and more particularly to an extrusion method for high temperature metallic and intermetallic alloys.

A large number of metallic and intermetallic materials for high temperature application to aircraft propulsion and airframe systems may be formed to semifinished or finished shapes via conventional deformation processes only with great difficulty. In conventional extrusion, a billet is preheated in a high temperature furnace or induction unit, placed into tooling which is heated to only relatively low temperatures (typically <500° F.) and then extruded through a die. Conventional extrusion practice for a high temperature metallic or intermetallic alloy also usually includes sealing it in a sacrificial can, which protects the alloy against oxidation during furnace or reduction preheating prior to extrusion and shields the alloy from die chilling as the billet-can assembly is extruded. Without the can, the billet may cool to a regime of poor workability and fail during the extrusion process.

To provide the desired protection against chilling, the can must not thin excessively or tear during extrusion and thus allow the billet to contact the die. The can material must therefore flow at about the same rate as the billet, that is, the deformation resistance (flow stress) of the can material should approximately equal that of the billet. Unfortunately, for most common inexpensive can materials (e.g., stainless steels, conventional titanium alloys), the flow stress (at the same temperature as the billet) is substantially less. In this case, the billet will move like a nearly rigid body into the soft can during the initial stages of extrusion, pinch the can wall and contact the die, and lead to partial or catastrophic failure.

The invention solves or substantially reduces in critical importance problems with conventional processes, by combining special processing parameters, can geometry and design of the interface layer between billet and can. By these means, a temperature differential between can and billet is established immediately prior to extrusion. Can temperature is reduced so that its flow stress is about equal to that of the hotter billet within, which enhances uniformity of can and billet flow.

A wide variety of metals and alloys, including difficult-to-work high temperature alloys, may be extruded using the method of the invention, to produce finished or semifinished products of a variety of extruded shapes, with an overall product yield approaching 100% of the starting material.

It is therefore a principal object of the invention to provide an improved extrusion process.

It is a further object of the invention to provide an extrusion process for metals and alloys, particularly difficult-to-work high temperature alloys.

It is yet another object of the invention to provide an extrusion process for difficult-to-work high temperature alloys utilizing inexpensive can materials.

These and other objects of the invention will become apparent as a detailed description of representative embodiments proceeds.

SUMMARY OF THE INVENTION

In accordance with the foregoing principles and objects of the invention, a method for extruding metals and alloys, particularly difficult-to-work high temperature alloys, is described which comprises inserting a billet of the metal or alloy into an extrusion can, heating the canned billet to a temperature in a temperature range in which the ductility of the billet material is substantially maximum, cooling the canned billet sufficiently to establish a preselected temperature difference between the billet and can at which the difference between the flow stress of the billet material and the flow stress of the can material is substantially minimum, and extruding the canned billet to preselected shape.

DESCRIPTION OF THE DRAWINGS

The invention will be more clearly understood from the following detailed description of representative embodiments thereof read in conjunction with the accompanying drawings wherein.

DETAILED DESCRIPTION

Figure 1A:
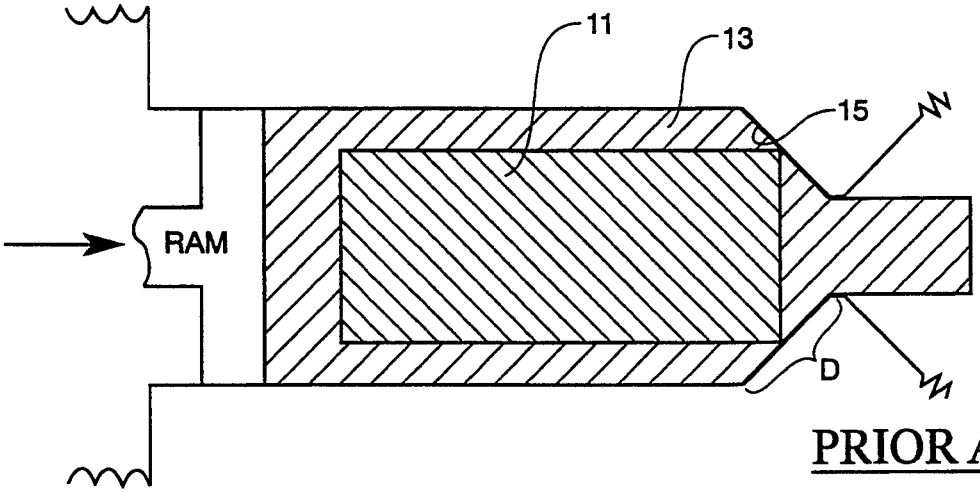
PRIOR ART Fig. 1a
FIGS. 1*a*,1*b* show the can and billet deformation by conventional extrusion and controlled dwell extrusion of the invention, respectively.
Figure 1B:
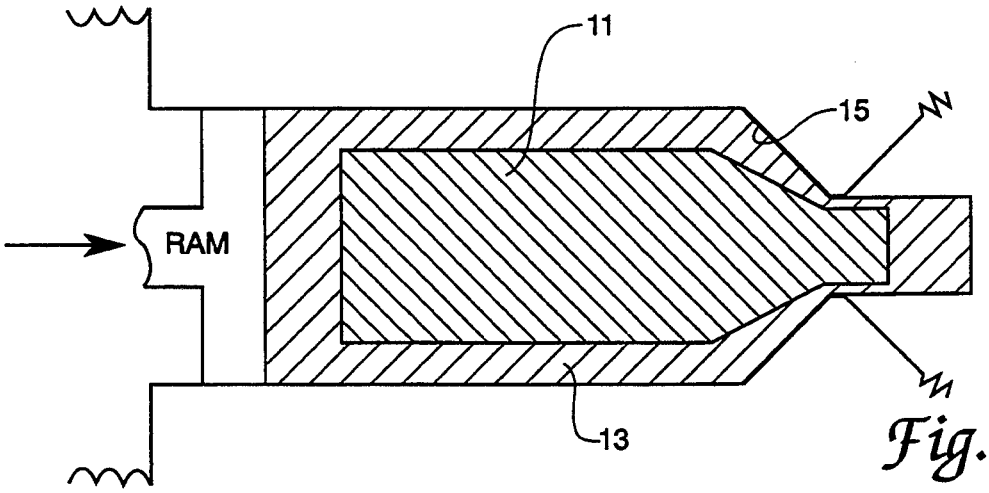

Referring now to the drawings, FIG. 1*a* illustrates conventional extrusion of a billet 11 within can 13. As suggested above, in conventional extrusion processes for high temperature alloys of interest herein, a mismatch exists between the flow stresses of can 13 and billet 11 materials which may result in thinning of can 13 by the harder billet 11 in region D of die 15 where deformation occurs. In accordance with a governing principle of the invention, if the flow stress of the can 13 material is made substantially equivalent to that of billet 11, a more uniform flow pattern obtains as suggested in FIG. 1*b*.

Figure 2:
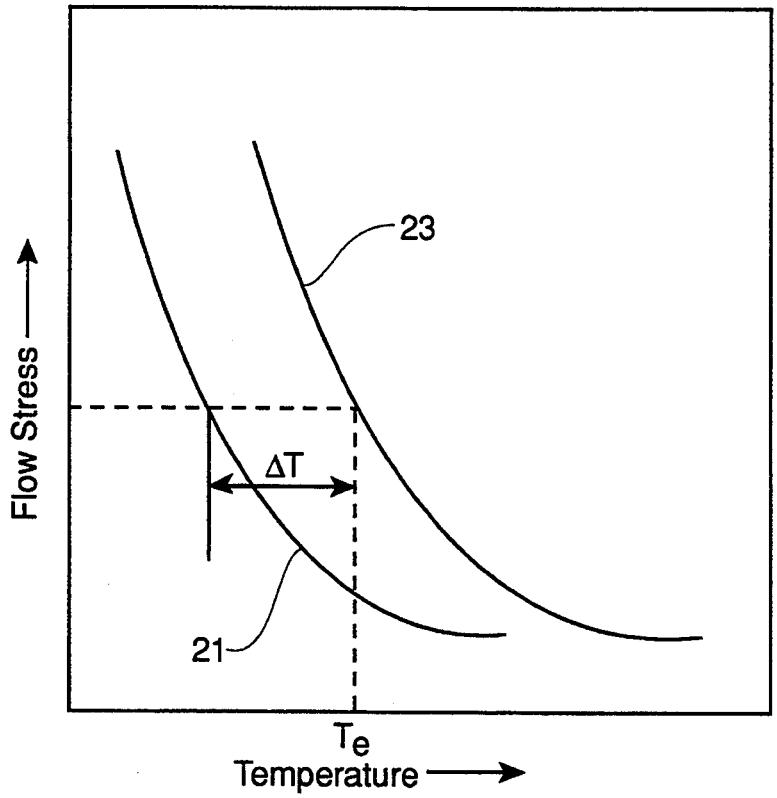
FIG. 2 shows schematically flow stress versus temperature for typical can and billet materials.
Figure 3:
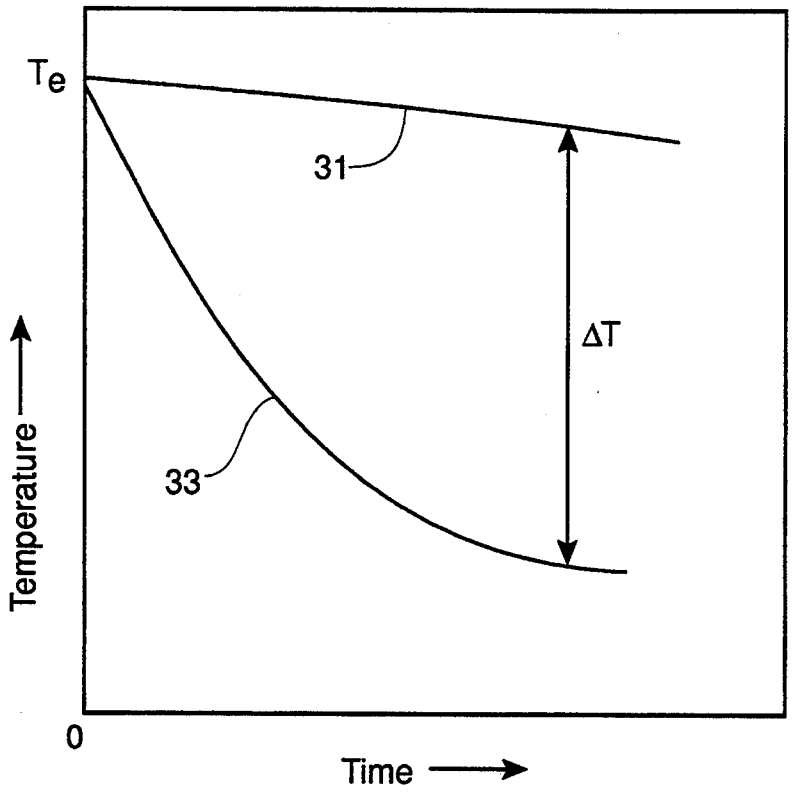
FIG. 3 shows cooling curves of temperature versus time for can and billet following preheat and prior to extrusion.

FIG. 2 shows schematically a typical plot 21 of flow stress versus temperature for a typical can material and the corresponding plot 23 for a typical billet material of interest. For a given billet temperature $T_b$ equal to or near extrusion temperature $T_e$ in a temperature regime of maximum ductility of the alloy, the can material, at a temperature equal to $T_e-\Delta T$, has a flow stress substantially equal to that of the billet. Referring now to FIG. 3, plots 31 and 33 illustrate cooling curves of temperature versus time for billet and can, respectively, immediately after preheat to $T_e$ and removal from the furnace and prior to extrusion. Heat losses during the period between preheat and extrusion (dwell period) are greater for the can than for the billet, and the average temperature $T_c$ of the can wall will drop more quickly than the average temperature $T_b$ of the billet. Selection according to the teachings of the invention of can wall thickness and can-billet interface configuration (affecting the heat transfer coefficient $h_o$ between can and billet) allows establishment of substantially any selected temperature difference $\Delta T = T_b - T_c$. As suggested below, materials may be used between billet and can in order to tailor the heat transfer character of the can-billet interface to ensure a large temperature drop (typically 200°-600° C.) in the can material relative to that in the billet (10°-40° C.). A heat transfer analysis on the billet, can and interface may be made by one having skill in the appropriate art to determine the dwell time required to achieve a desired ΔT for selected billet and can materials and interface/can configurations. However, direct measurement of can temperature by any suitable conventional temperature monitoring means, such as a pyrometer, may conveniently indicate to the skilled artisan practicing the invention the optimum point in time at which to begin extrusion based on plots such as that of FIG. 2.

Billet materials suitable for extrusion utilizing the method of the invention may include a wide range of difficult-to-work high temperature alloys, including, but not limited to, conventional nickel and titanium based alloys and intermetallics such as titanium aluminides (alpha-two, gamma, and orthorhombic base), nickel, iron, and niobium aluminides, silicides (e.g., niobium, molybdenum and titanium silicides ), and beryllides, such as nickel-base superalloys Waspaloy, Astroloy, Udimet 700, IN-100, Rene 95; nickel-iron-base superalloys 718 and 901; iron-base superalloy A-286; alpha-two base titanium aluminides Ti—24Al—11Nb, Ti—25Al—10Nb—3V—1Mo, Ti—25Al—17Nb (atomic percent); gamma-base titanium aluminides Ti—(45-48)Al—2Cr—2Nb, Ti—46Al—5Nb—1W, Ti—51Al—2Mn, Ti—(45-48)Al—2Mn—2Nb; orthorhombic titanium aluminides Ti—22Al—23Nb, Ti—22Al—27Nb (atomic percent); nickel aluminides based on $Ni_3Al$ or NiAl; iron aluminides based on $Fe_3Al$ or FeAl; $Nb_3Al$ and $NbAl_3$; niobium silicides such as those based on Nb—$Nb_5Si_3$; silicides based on $MoSi_2$; and beryllides such as $Be_{12}Nb$, $Be_{17}Nb_2$, $Be_{19}Nb_2$, $Be_{12}Ti$, $Be_{12}Ta$, $Be_{13}Zr$, in cast, wrought, or powder form, with or without prior heat treatment, HIP or other treatment. Any suitable can material may be used, as would occur to the skilled artisan, preferably one characterized by a sharp dependence of flow stress on temperature and which does not form low melting point eutectic phases with the billet during preheating, such as stainless steels and conventional titanium alloys, various carbon and constructional steels, nickel-base alloys, and refractory metal alloys.

Conventional extrusion rates for an alloy selected for extrusion in the practice of the invention may be employed by one skilled in the art. For the alloys of interest herein, extrusions rates may be in the range of about 0.5 to about 10 in/sec at the respective temperature at which the hot workability of the alloy is sufficiently high.

Figure 4:
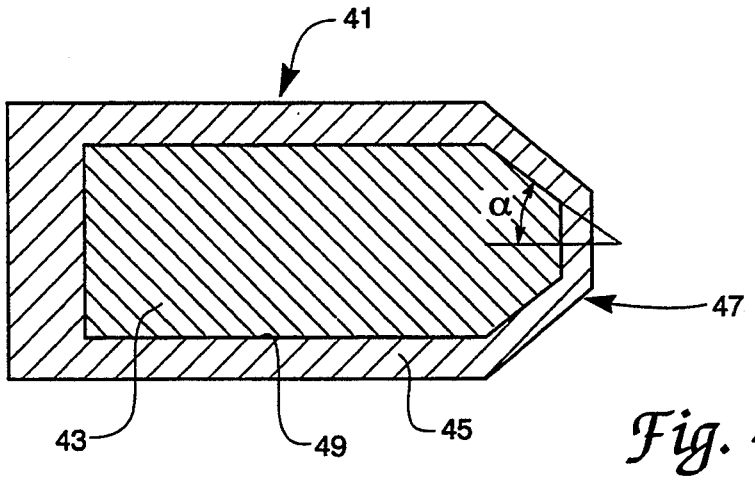
FIG. 4 shows an extrusion can design with uniform thickness in the cylindrical and nose walls.

Referring now to FIG. 4, shown therein in axial cross section is a typical billet-can configuration 41 suitable for performing billet extrusions according to the invention. In representative configuration 41 shown in FIG. 4, billet 43 is contained in can 45, each having generally cylindrical shape. Nose end 47 of can 45 and billet 43 may be tapered substantially as shown to facilitate entry into an extrusion die (not shown in FIG. 4). Although can configuration needed to result in a substantially uniform temperature throughout the can may be selected by the skilled artisan practicing the invention and is not considered limiting of the invention herein, it may be generalized that the thickness of the cylindrical wall of can 45 is equal to that of the wall of nose end 47. The taper defined in nose end 47 may take a wide range of values but is typically $\alpha$ equals 15° to 60°.

The value of ΔT after a given dwell period can be adjusted by suitable selection of can wall thickness relative to the billet diameter. Alternatively, a selected heat transfer coefficient of the can-billet interface may be achieved by disposing at interface 49 between can 45 and billet 43 selected parting agents such as calcium oxide, yttria or zirconia or woven ceramic insulating materials such as silica, or multiple wraps of foil such as tantalum, molybdenum, or stainless steel coated with parting agents. The effective heat transfer coefficient is a function of the number of interface layers selected as determinable by one with skill in the art practicing the invention. In general, the effective interface heat transfer coefficient for n layers of insulation material/foil is equal to 1/n times the heat transfer coefficient $h_o$ which pertains to a single layer.

Successful extrusions in demonstration of the invention were performed on several gamma titanium aluminide alloy billets in type 304 stainless steel and Ti—6Al—4V cans and were made using a 700-ton Lombard press and a Bliss 2500 ton press, all as shown in Table 1.

The extrudate in the demonstration trials was generally cylindrical or rectangular in shape, but within the scope of these teachings and the appended claims, the extrudate and the corresponding extrusion die may have any cross section (e.g., round, rectangular, I, L, H). The extrusion die may be conical, streamlined or other conventional form, heated or unheated.

The extrusions in demonstration of the invention were performed following a controlled dwell period during which the billet and can were allowed to cool in air. It is noted however that any suitable environment may be selected, such as controlled temperature (heated or cooled) inert gas liquid environment. Alternatively, the billet and can may also be held during the controlled dwell period inside the extrusion die, which may serve to chill the can prior to extrusion. Although the invention as described herein has incorporated conventional extrusion, other metalworking processes well known in the art may be used, such as coextrusion, hydrostatic extrusion, swaging, pack rolling, or forging of round, flat, or shaped articles. Further, it is noted that the invention may be applied by one skilled in the art to the extrusion of metals and alloys other than those specifically named herein.

The invention therefore provides an improved extrusion process particularly suited to difficult-to-work high temperature alloys. It is understood that modifications to the invention may be made as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

TABLE 1

| Type of Extrusion | Billet Alloy | Can Material | Interface Insulation | Extrusion Geometry | Extrusion Ratio | Extrusion Speed (in/s) | Furnace Temp (°F.) | Dwell Time (sec) |
|---|---|---|---|---|---|---|---|---|
| Controlled Dwell (1) | Ti-49.5Al-1.1Mn-2.5Nb | 304 SS | silica | round-to-round | 6:1 | 1 | 2100 | 30 |
| Controlled Dwell (1) | Ti-49.5Al-1.1Mn-2.5Nb | 304 SS | silica | round-to-rectangular | 6:1 | 1 | 2100 | 30 |
| Controlled Dwell (1) | Ti-45.5Al-2Cr-2Nb | 304 SS | silica | round-to-rectangular | 6:1 | 1 | 2200 | 30 |
| Controlled Dwell (1) | Ti-45.5Al-2Cr-2Nb | Ti-6Al-4V | silica | round-to-round | 6:1 | 1 | 2370 | 20 |
| Controlled Dwell (2) | Ti-49.5Al-1.1Mn-2.5Nb | 304 SS | silica | round-to-round | 6:1 | 1 | 2100 | 90 |
| Conventional Extrusion (3) | Ti-49.5Al-1.1Mn-2.5Nb | 304 SS | none | round-to-round | 6:1 | 0.5 | 2100 | 0 |
| Conventional Extrusion (3) | Ti-49.5Al-1.1Mn-2.5Nb | 304 SS | none | round-to-rectangular | 6:1 | 1 | 2100 | 0 |
| Conventional Extrusion (2) | Ti-49.5Al-1.1Mn-2.5Nb | Ti-6Al-4V | none | round-to-rectangular | 6:1 | 1 | 2460 | 0 |

(1) Successsful extrusion.
(2) Unsuccessful extrusion: nose fracture.
(3) Unsuccessful extrusion: can failure.

We claim:

1. A method for extruding a metal or alloy material, comprising the steps of:

(a) inserting a billet of metal or alloy material into an extrusion can to provide a canned billet:

(b) heating said canned billet to a temperature in a temperature range in which the ductility of the billet material is substantially maximum;

(c) cooling said canned billet sufficiently to establish a preselected temperature difference between said billet and said can at which the difference between the flow stress of said billet material and the flow stress of the can material is substantially minimum; and (d) extruding said canned billet to preselected shape.

2. The method of claim 1 wherein said can material is a stainless steel alloy, a carbon steel alloy, a titanium alloy, or a nickel alloy.

3. The method of claim 1 wherein the step of extruding said canned billet to preselected shape is performed at an extrusion rate in the range of about 0.5 to about 10 inches per second at a temperature in said temperature range in which the ductility of said billet material is substantially maximum.

4. The method of claim 1 wherein a parting agent or interface layer is disposed between said billet and can.

5. The method of claim 4 wherein said parting agent or interface layer is selected from the group consisting of calcium oxide, yttria, zirconia, silica, tantalum foil, molybdenum foil, and stainless steel foil.

* * * * *